United States Patent [19]

Aujla

[11] 4,156,554

[45] May 29, 1979

[54] COAXIAL CABLE ASSEMBLY

[75] Inventor: Sharanjit S. Aujla, Bramalea, Canada

[73] Assignee: International Telephone and Telegraph Corporation, New York, N.Y.

[21] Appl. No.: 894,411

[22] Filed: Apr. 7, 1978

[51] Int. Cl.[2] ..... H01R 17/04

[52] U.S. Cl. ..... 339/177 R; 174/89

[58] Field of Search ..... 339/177 R, 177 E; 174/75 C, 88 C, 89

[56] References Cited

U.S. PATENT DOCUMENTS

| | | | |
|---|---|---|---|
| 3,639,890 | 2/1972 | Stevens et al. | 339/177 R |
| 3,668,612 | 6/1972 | Nepovim | 339/177 R |
| 3,781,762 | 12/1973 | Quackenbush | 339/177 R |

FOREIGN PATENT DOCUMENTS

| | | | |
|---|---|---|---|
| 778781 | 7/1957 | United Kingdom | 339/177 R |
| 1490421 | 11/1977 | United Kingdom | 339/177 R |

*Primary Examiner*—Neil Abrams

*Attorney, Agent, or Firm*—A. Donald Stolzy

[57] ABSTRACT

A coaxial cable and an electrical connector therefor including a back-nut threaded to a body to receive a female fitting. The body has a stop for the back-nut. The back-nut has an internal shoulder. The body has an internal frusto-conical surface. A conductive ferrule is also provided. A cylindrical member clamps a cylindrical portion of the ferrule to the cable outer conductor. The ferrule has a shoulder. The ferrule also has a slotted frusto-conical surface to fit against the frusto-conical surface of the body. The slots form spring projections that are held in pressure contact with and in good electrical contact with the said body surface. The back-nut shoulder pushes the ferrule toward the body as the back-nut is threaded thereto. The back-nut has a flange behind which a gasket gland is retained. The clamping member is held in axial compression between the ferrule shoulder and the gasket gland. The gasket gland then provides a seal between the back-nut and the cable, the cable being surrounded by the flange.

6 Claims, 8 Drawing Figures

COAXIAL CABLE ASSEMBLY

BACKGROUND OF THE INVENTION

This invention relates to an electrical assembly and, more particularly, to a coaxial cable with a radio frequency interference (RFI) proof and/or weather proof connector.

PRIOR ART STATEMENT

Two searches were made. The following is an incomplete list of the patents cited in the search. However, this list includes what are believed to be the pertinent patents.

| Inventor | U.S. Pat. No. |
|---|---|
| Dupre et al. | 2,958,845 |
| O'Keefe et al. | 3,281,756 |
| O'Keefe et al. | 3,297,979 |
| Brishka | 3,432,798 |
| Hutter et al. | 3,646,502 |
| Nepovim | 3,671,926 |

In Dupre et al., see tapered pin 8.

In O'Keefe et al., 3,281,756, see "crimped" in column 2, line 5.

In O'Keefe et al., U.S. Pat. No. 3,297,979, see "a housing crimping sleeve 32" in column 3, line 26.

In Brishka, see "a clamp gasket" in line 19 of column 2.

In Hutter et al., see "a standard crimp ferrule 54" in lines 38–39 of column 2.

In Nepovim, see FIG. 3 and the first full paragraph in column 6.

The need for effective shielding of coaxial interconnections has increased significantly with the rapidly expanding use of electronic equipment for communications and data processing systems. In addition, government specification BP23 has now placed more stringent limits on the amount of signal that can lawfully leak out of or leak into a cable interconnect system. The signal which leaks into such a system is called radio frequency interference (RFI). RFI leaks into the system through poor shielding of connectors for coaxial drop cables. In this regard, existing fittings known as 'F' fittings offer very little protection against destructive corrosion brought about by the ingress of today's polluted atmosphere at the connecting region and around the components. The operation of such a degraded connection in the high signal level and freuqency ranges ultimately becomes a prime source of RFI. Resulting from the described conditions, the frequent replacement of malfunctioning components is necessary. This then increases costs and maintenance.

SUMMARY OF THE INVENTION

According to the present invention, there is provided an electrical assembly comprising: a coaxial cable having an end portion, a center conductor, a dielectric surrounding said center conductor, an outer conductor which may be comprised of a braid, a foil, or a hollow tube surrounding said dielectric, an insulating jacket surrounding said outer conductor, and said outer conductor being stripped away from said dielectric over said cable end portion; a conductive ferrule having a passageway therethrough somewhat larger in size than said dielectric, said cable end portion projecting through said passageway, said ferrule having first and second axial portions, said first portion having a frusto-conical external surface around said cable end portion, said first portion being axially slotted to form resilient prongs; a back-nut surrounding said first and second ferrule portions; a conductive body to which said back-nut is threaded; said body having a frusto-conical internal surface to mate with said ferrule frusto-conical surface, said back-nut being so threaded and constructed that said prongs lie in pressure contact with said body surface to make good electrical contact therewith; and securing means to hold said cable jacket and outer conductor and said ferrule second portion in fixed positions relative to each other and in pressure contact and in electrical contact with each other.

BRIEF DESCRIPTION OF THE DRAWINGS

In the accompanying drawings which illustrate exemplary embodiments of the present invention.

DESCRIPTION OF THE PREFERRED EMBODIMENTS

The present invention may be employed in, for example, the CATV industry as a new and improved 'F' fitting for aerial installations of a communication channel between the distribution trunk and the subscribers' premises. Other uses are, of course, possible. The present invention provides and RFI-proof and weather-proof connector system resulting in reduced CATV system operating costs and maintenance.

Figure 6:
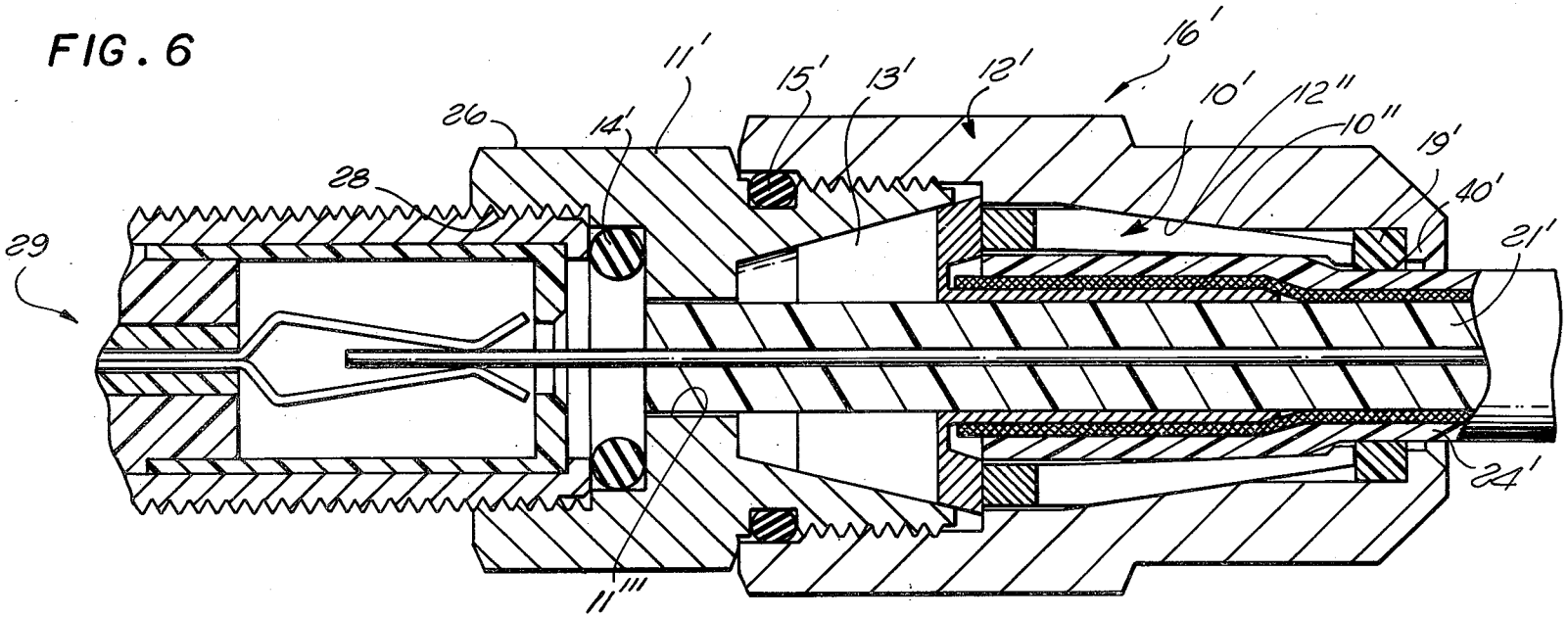
FIG. 6 is a longitudinal sectional view of an alternative embodiment of the present invention.
Figure 8:
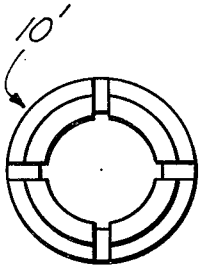
FIG. 8 is an end elevational view of the collet taken on the line 8—8 shown in FIG. 7.
Figure 7:
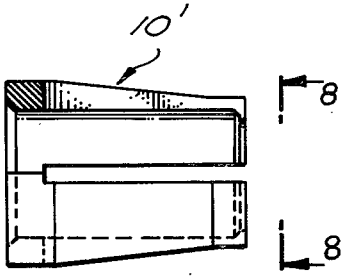
FIG. 7 is a side elevational view, partly in section, of a seizing collet shown in FIG. 6.
Figure 4:
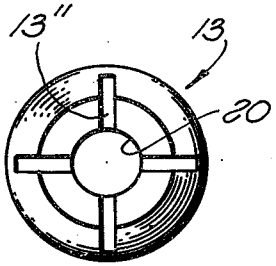
FIG. 4 is an end elevational view of a ferrule shown in FIG. 3, and taken on the line 4—4 shown therein.

The accompanying drawings illustrate two embodiments. One embodiment is shown in FIGS. 1–5. The other is shown in FIGS. 6–8. Both embodiments are identical except that a female fitting 29 in FIG. 6 is omitted in FIG. 1, and a seizing collet 10' is employed in FIG. 6, whereas a retention sleeve 10 is employed in FIG. 2 in lieu of the collet 10'.

Figure 1:
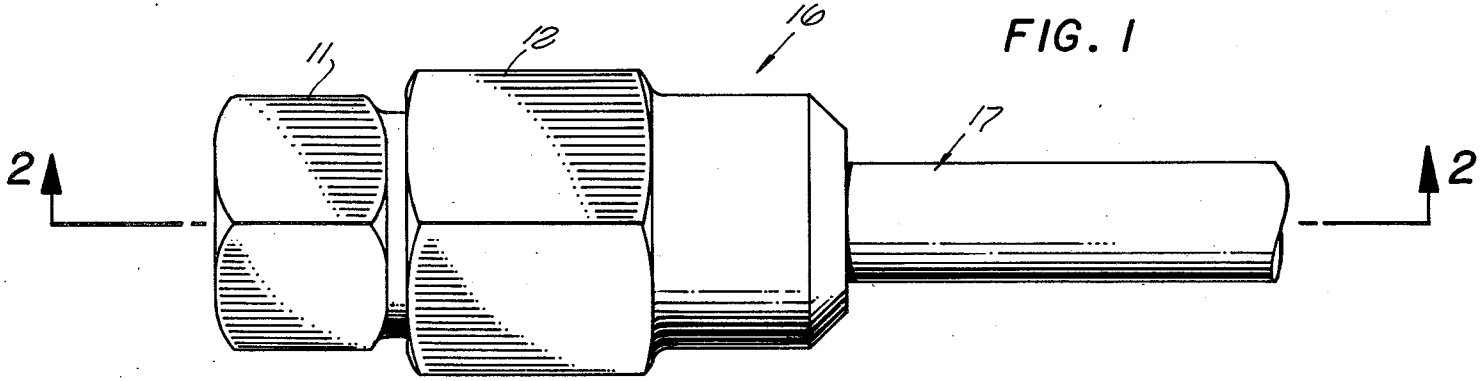
FIG. 1 is a side elevational view of a cable and connector assembly.
Figure 2:
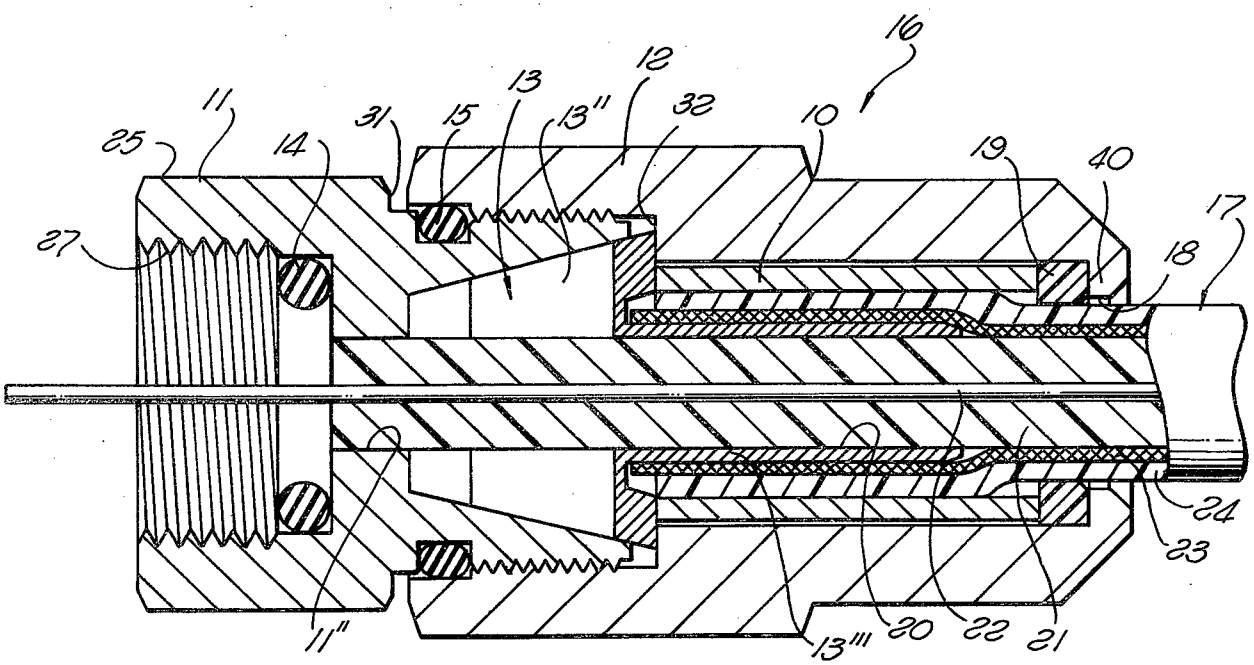
FIG. 2 is a longitudinal sectional view of the assembly shown in FIG. 1, and taken on the line 2—2, shown therein.
Figure 3:
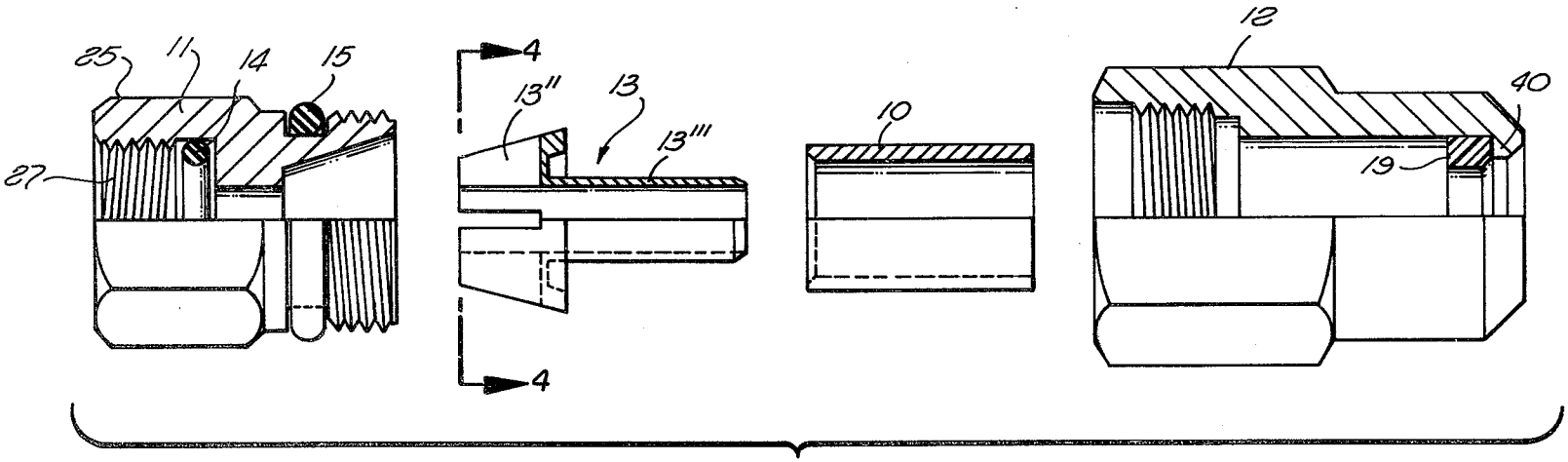
FIG. 3 is an exploded elevational view, partly in section, of the assembly shown in FIGS. 1 and 2.
Figure 5:
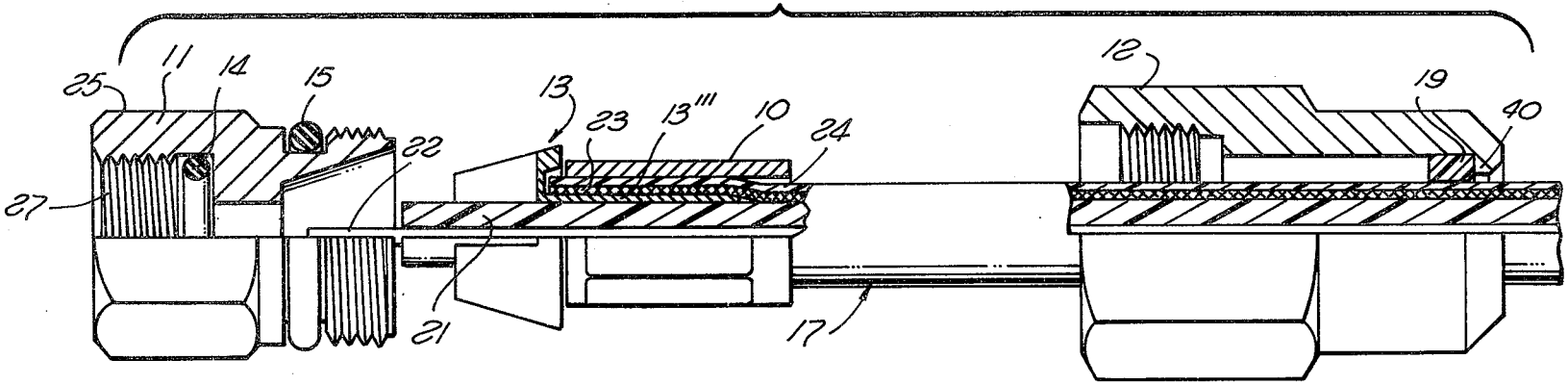
FIG. 5 is an exploded subassembly, partly in section, of the cable and connector shown in FIGS. 1–4.

FIGS. 2 and 6, respectively, have bodies 11 and 11', back-nuts 12 and 12', ferrules 13 and 13', and sealing rings (O-rings) 14, 15 and 14', and 15'. Back-nuts 12 and 12' have flanges 40 and 40', respectively, that retain gasket glands 19 and 19', respectively, in FIGS. 2 and 6, respectively. Back-nut 12' is also provided with a tapered section 12'' complimentary to the tapered section 10'' of the seizing collet 10'.

As shown in FIGS. 2 and 6, the connectors to the cable assemblies are indicated at 16 and 16', respectively. In FIG. 2, a coaxial cable 17 is inserted through a rear wall bore 18 of back-nut 12, a gasket gland 19, and the tubular retention sleeve 10.

The ferrule 13 is provided with an axially slotted frusto-conical front portion 13'' and a reduced diametercylindrical rear portion 13'''. Cable 17 has a dielectric 21, a center conductor 22, an outer conductor 23, and a polyvinyl chloride outer jacket 24, or one made of any conventional material. The ferrule 13 has a central bore 20 to to permit passage of the dielectric 21 and center conductor 22. The cable 17 is assembled to the ferrule 13 by inserting the ferrule tubular rear portion 13''' between the dielectric 21 and the outer conductor 23 until the cable jacket 24 and the outer conductor 23 reach ferrule front portion 13''. The cable dielectric 21 and center conductor 22 extend outside the front face of the ferrule 13 (the left face as viewed in FIG. 2). Cable retention is accomplished by forming tubular retention sleeve 10 into a hexagon crimp over the portion of the cable jacket 24 overlapping the tubular rear portion 13''' of the ferrule 13.

As shown in FIG. 6, cable retention may also be accomplished by using wedge shaped, axially slotted seizing collet 10'. The seizing collet 10' may be made from either metallic or non-metallic materials such as plastics, etc.

The bodies 11 and 11' have center bores 11'' and 11''', respectively, in FIGS. 2 and 6, respectively. Center bores 11'' and 11''' accomodate cable dielectrics 21 and 21', respectively. Bodies 11 and 11' have front portions 25 and 26, respectively, with internal threads 27 and 28, respectively, to permit connection to the output terminals on taps/couplers and similar devices that utilize female 'F' fittings. The rear portion of the body is provided with external threads to allow coupling to the back-nut, and has a conical inside surface complementary to the frustum profile of the ferrule 13.

In FIG. 2, body 11 is first installed on a female fitting such as fitting 29 in FIG. 6. In FIG. 2, back-nut 12 is then threaded onto the body 11. In so doing, the frustum profile of the ferrule 13 is brought into contact with the inside conical surface of the body 11 and, at the same time, the gasket gland 19 (19' in FIG. 6) is compressed between the crimp sleeve 10 and the rear inner shoulder of the back-nut 12.

In the case of FIG. 6, the base of the frustum of the ferrule 13' pushes against the seizing collet 10'. The collet 10' compresses the gasket gland 19. Collet 10' also seizes on the cable jacket 24'. Tightening either of the back-nuts 12 or 12' continues until a positive stop is reached at, for example, 31 and/or 32. See, however, FIG. 6 also. This ensures that the frustum of ferrule 13 in FIG. 2 is properly seated in the cavity of body 11. The degree of gasket gland compression which is produced effects a reliable seal between the cable 17 and the connector 16 without damaging the gasket gland 19.

The frustum of the ferrule 13 is slotted to allow deformation of the conical surfaces while consistently maintaining a positive ground for the cable 17. Grounding contact pressure at the conical surface is automatically provided when the back-nut 12 is tightened to the positive stop. When properly assembled and mated, adequate sealing is achieved between the body 11 and the back-nut interface, and between the body 11 and the mating female 'F' fitting.

Some outstanding advantages that can be derived from the present invention over prior art devices are as follows:

(a) The back-nut 12 herein acts as an enclosure of the cable 17 to connector interconnect area, thereby offering increased shielding effectiveness against RFI.

(b) The assembly of the present invention gives positive grounding of the outer conductor 23 of cable 17 to the connector body 11. From the connector body 11 to the mating female fitting 29 in either of the embodiments of FIGS. 2 and 6 or to the female 'F' fitting, grounding is achieved by means of a conductive sealing ring inside the body as well as through the body itself.

(c) The weather-proof construction of the embodiments disclosed herein protects contacting surfaces from degrading due to atmospheric corrosion. Electrical integrity is therefore maintained for a long period of time.

(d) On prior art 'F' fittings, any cable bending occurring at the relatively sharp edge on a ferrule rear portion would ultimately result in a severely damaged cable outer conductor and dielectric. Contrary to this, the present invention causes the back-nut 12 to act as a bending stress relief member by allowing the cable bending to occur away from the edge of the ferrule rear portion 13'''. The mechanical and electrical integrity of the interconnection are thus maintained. An independent stress relief device such as a kellums grip, etc., can also be incorporated by making slight modifications to the rear entry of the ferrule.

(e) On the whole, the present invention offers a structurally superior interconnect system.

(f) The connector of the present invention is more closely matched to the nominal impedance of the coaxial cable and hence provides superior overall electrical characteristics.

(g) Where the present invention relates basically to metallic structural members, it must be noted that with the inclusion of suitable conductive additives, non-metallic materials such as elastomers and plastics may be used for the back shell and body components, etc., described herein.

I claim:

1. An electrical assembly comprising: a coaxial cable having an end portion, a center conductor, a dielectric surrounding said center conductor, and an outer conductor surrounding said dielectric, an insulating jacket surrounding said outer conductor, and said outer conductor being stripped away from said dielectric over said cable end portion; a conductive ferrule having a passageway therethrough somewhat larger in size than said dielectric, said cable end portion projecting through said passageway, said ferrule having first and second axial portions, said first portion having a frusto-conical external surface around said cable end portion, said first portion being axially slotted to form resilient prongs; a back-nut surrounding said first and second ferrule portions; a conductive body to which said back-nut is threaded, said body having a frusto-conical internal surface to mate with said ferrule frusto-conical surface, said back-nut being so threaded and constructed that said ferrule prongs lie in pressure contact with said body internal surface to make good electrical contact therewith; and securing means to hold said cable jacket and outer conductor and said ferrule second portion in fixed positions relative to each other and in pressure contact and in electrical contact with each other, wherein said securing means includes a member surrounding said cable jacket and outer conductor and said ferrule second portion in a manner to clamp the same together, and wherein said back-nut has a flange close to and surrounding said cable and forming an annular pocket therein, a sealing gasket gland in said pocket close to said flange and said cable, said ferrule having a shoulder, said member being annular and in axial compression between said ferrule shoulder and said gasket gland to cause said gasket gland to provide a seal between said back-nut and said cable.

2. The invention as defined in claim 1, wherein said body has a stop to limit axial movement of said back-nut when said back-nut is threaded to said body.

3. The invention as defined in claim 2, wherein said back-nut has a shoulder to engage said ferrule shoulder for pressing said first portion into said body.

4. The invention as defined in claim 3, wherein a first O-ring seal is positioned between said back-nut and said body, said body having a second O-ring to seal to a female fitting.

5. The invention as defined in claim 4, wherein said body has a hole therethrough somewhat larger than said dielectric, said cable end portion extending through said hole.

6. The invention as defined in claim 5, wherein said cable includes an outer jacket surrounding said outer conductor, said ferrule second portion including a cylinder clamped by said securing means between said outer conductor and said dielectric, said securing means surrounding said outer jacket.

* * * * *